US010938160B2

(12) United States Patent
Lee et al.

(10) Patent No.: US 10,938,160 B2
(45) Date of Patent: Mar. 2, 2021

(54) CONNECTOR WITH A NARROWED HOUSING PORTION AND A MOUNTED DETECTOR BODY

(71) Applicant: Sumitomo Wiring Systems, Ltd., Mie (JP)

(72) Inventors: Minho Lee, Seongnam-si (KR); Hideto Nakamura, Seongnam-si (KR)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/569,871

(22) Filed: Sep. 13, 2019

(65) Prior Publication Data

US 2020/0091656 A1 Mar. 19, 2020

(30) Foreign Application Priority Data

Sep. 14, 2018 (JP) ..... JP2018-172196

(51) Int. Cl.
*H01R 13/641* (2006.01)
*H01R 13/502* (2006.01)
*H01R 13/627* (2006.01)

(52) U.S. Cl.
CPC ..... *H01R 13/641* (2013.01); *H01R 13/502* (2013.01); *H01R 13/6272* (2013.01)

(58) Field of Classification Search
CPC ..... H01R 13/641; H01R 13/502; H01R 13/6272; H01R 13/6271; H01R 13/6273; H01R 13/6275
USPC ..... 439/489, 350, 352, 357, 358, 488
See application file for complete search history.

(56) References Cited

U.S. PATENT DOCUMENTS 6,126,468 A * 10/2000 Matsushita ..... H01R 13/5219 439/271
6,752,644 B2 * 6/2004 Shibata ..... H01R 13/5219 439/271
6,793,513 B2 * 9/2004 Shibata ..... H01R 13/5219 439/271
6,929,499 B2 * 8/2005 Nakamura ..... H01R 13/6272 439/352
7,578,694 B2 * 8/2009 Takahashi ..... H01R 13/506 439/352
9,270,055 B2 * 2/2016 Campbell ..... H01R 43/26
10,050,382 B2 * 8/2018 Droesbeke ..... H01R 13/506
2007/0275589 A1 11/2007 Ohtaka et al.
2008/0268685 A1 * 10/2008 Mase ..... H01R 13/633 439/271

FOREIGN PATENT DOCUMENTS

JP 4977404 7/2012

* cited by examiner

*Primary Examiner* — Travis S Chambers
(74) *Attorney, Agent, or Firm* — Gerald E. Hespos; Michael J. Porco; Matthew T. Hespos

(57) ABSTRACT

A connector has a detector (11) provided in a housing (10) movably in a front-rear direction and allowed to move from a standby position to a detection position in front of the standby position when both housings (10, 90) are connected properly. The housing (10) includes housing narrowing portions (76) narrowed toward a rear part, and the detector (11) includes two side walls (53) configured to cover both side surfaces of the rear part of the housing (10). The side walls (53) include detecting member narrowing portions (56) narrowed to correspond to the housing narrowing portions (76) in parts facing the housing narrowing portions (76).

1 Claim, 19 Drawing Sheets

CONNECTOR WITH A NARROWED HOUSING PORTION AND A MOUNTED DETECTOR BODY

BACKGROUND

Field of the Invention

The present invention relates to a connector.

Related Art

Japanese Patent No. 4977404 discloses a connector that includes a connector housing and a detector mounted in the connector housing for movement between a restricting position and an allowing position.

The detector is allowed to move from the restricting position to the allowing position when the connector housing is connected to a mating connector. The connector housing is in the form of a rectangular block and both side surfaces are formed to have a constant width along a front-rear direction. The detector includes a second tubular portion in a rear part. Both side surfaces of the second tubular portion cover the both side surfaces of a rear part of the connector housing and have a constant width along the front-rear direction.

In the above case, since the detector surrounds the outer periphery of the connector housing, the entire connector tends to be large.

The invention was completed on the basis of the above situation and aims to provide a smaller connector.

SUMMARY

The invention is directed to a connector with a housing connectable to a mating housing. A detector is provided in the housing and is movable in a front-rear direction. The detector can move from a standby position to a detection position in front of the standby position when the housing is properly connected to the mating housing. The housing includes a housing narrowing portion narrowed toward a rear end. The detector includes two side walls configured to cover both side surfaces of the rear part of the housing. Areas of the side walls of the detector that face the housing narrowing portion include a detector narrowing portion that is narrowed toward the rear to correspond to the housing narrowing portion. Thus, the connector can be narrowed in the part where the detecting member narrowing portion and the housing narrowing portion face each other. Further, the detector can be moved from the standby position to the detection position in front of the standby position by pressing a narrowing part of the detector narrowing portion.

An outer surface of the detector narrowing portion may include steps arranged in the front-rear direction. The steps can be pressed by a worker's fingers when moving the detector from the standby position to the detection position in front of the standby position, and thus the steps prevent the worker's fingers from slipping.

DETAILED DESCRIPTION

One embodiment is described with reference to FIGS. 1 to 19. A connector of this embodiment includes a housing 10, a detector 11 and terminal fittings 12. The housing 10 is connectable to a mating housing 90. In the following description, surfaces of the housing 10 and the mating housing 90 facing each other at the start of connection are referred to as front ends, and a vertical direction is based on FIGS. 3 to 5, 9 to 12, 14, 16 and 17.

Figure 4:
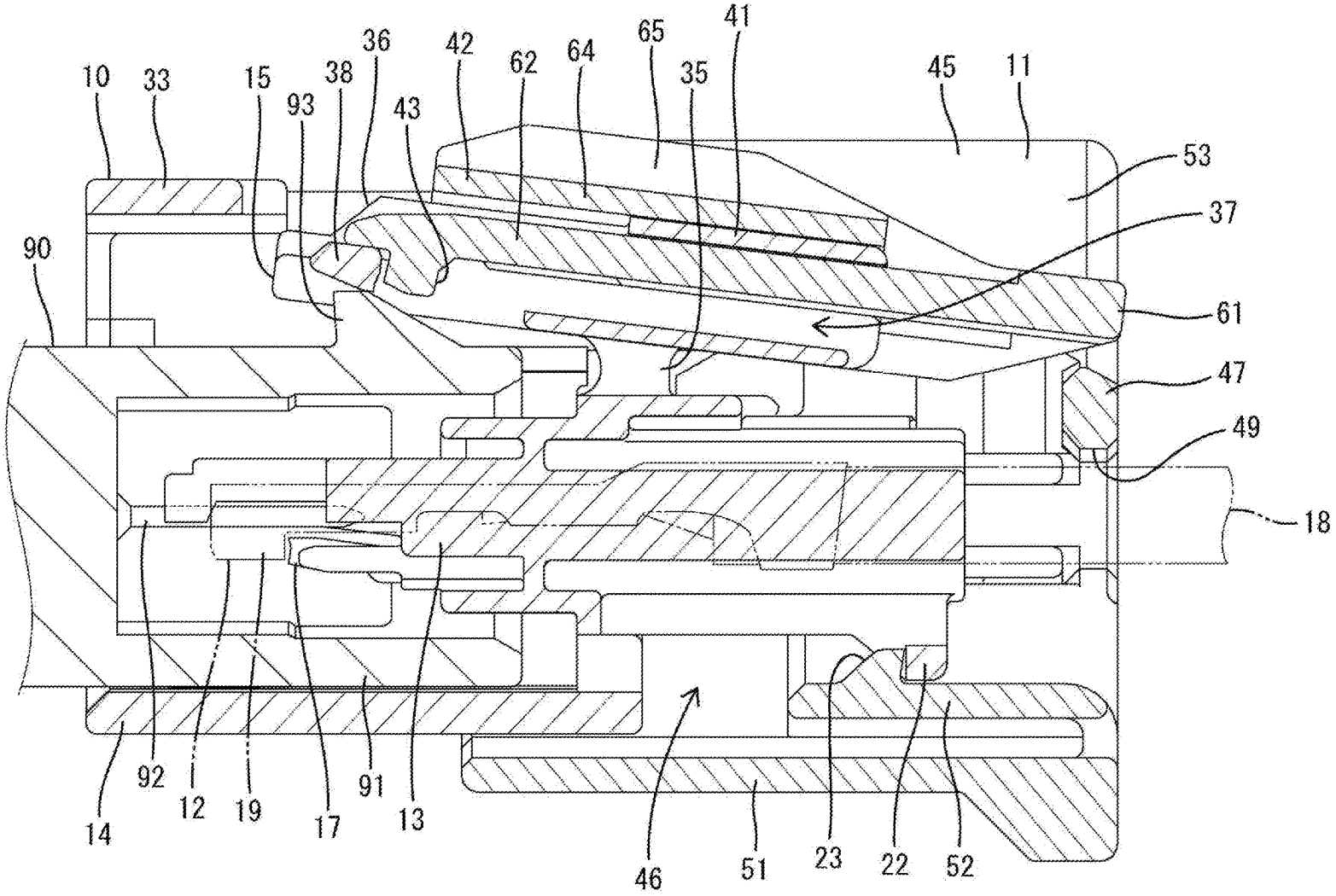
FIG. 4 is a section, corresponding to FIG. 3, showing a state while the housing is being connected to the mating housing from a state of FIG. 3.
Figure 5:
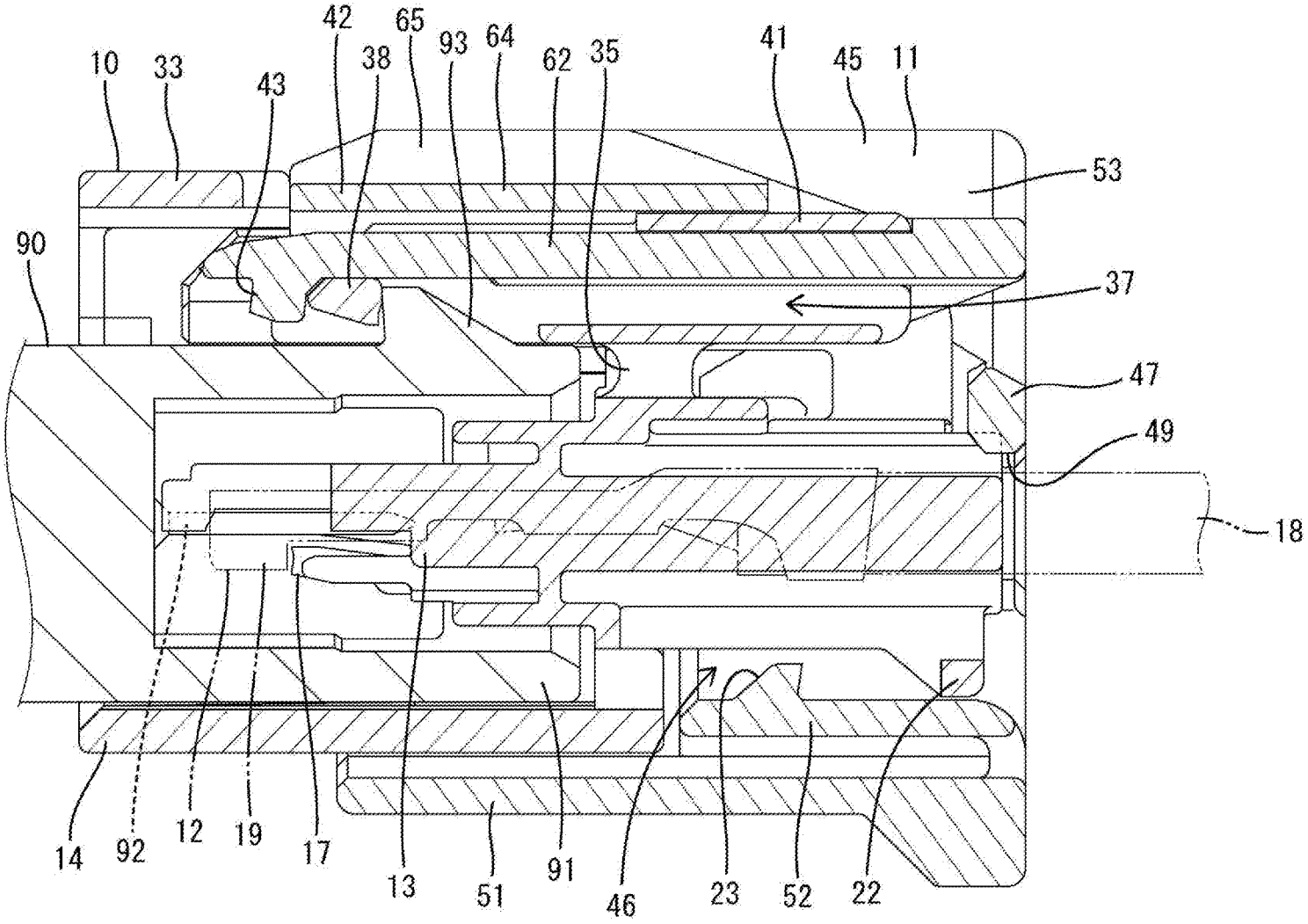
FIG. 5 is a section along B-B of FIG. 2.

The mating housing 90 is made of synthetic resin and includes, as shown in FIGS. 4 and 5, a tubular receptacle 91 directly connected to an unillustrated device and projecting forward. Tab-like mating terminal fittings 92 project into the receptacle 91. The receptacle 91 includes a claw-like projecting lock 93 on the upper surface of an upper wall.

Figure 16:
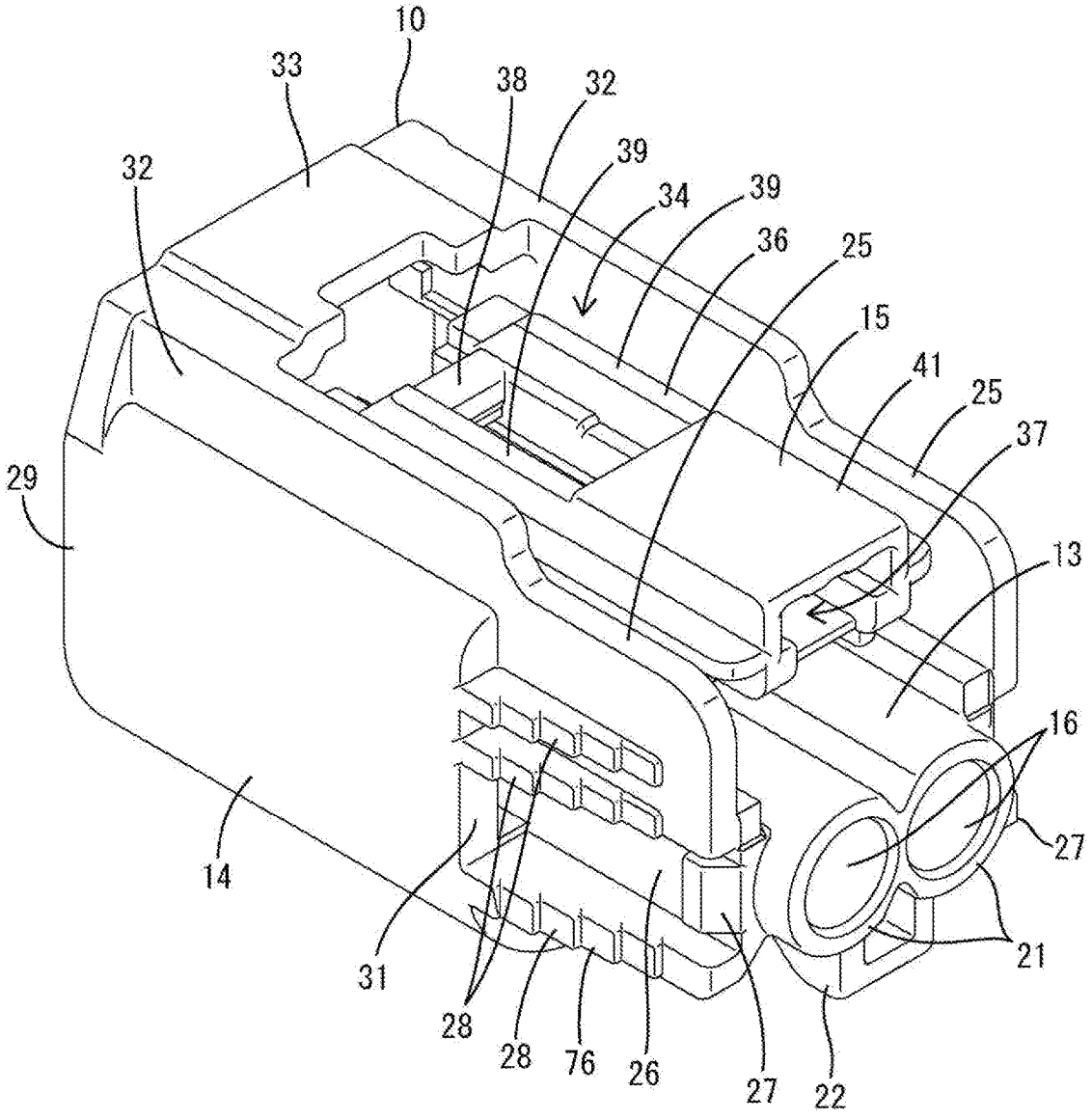
FIG. 16 is a perspective view of the housing.
Figure 17:
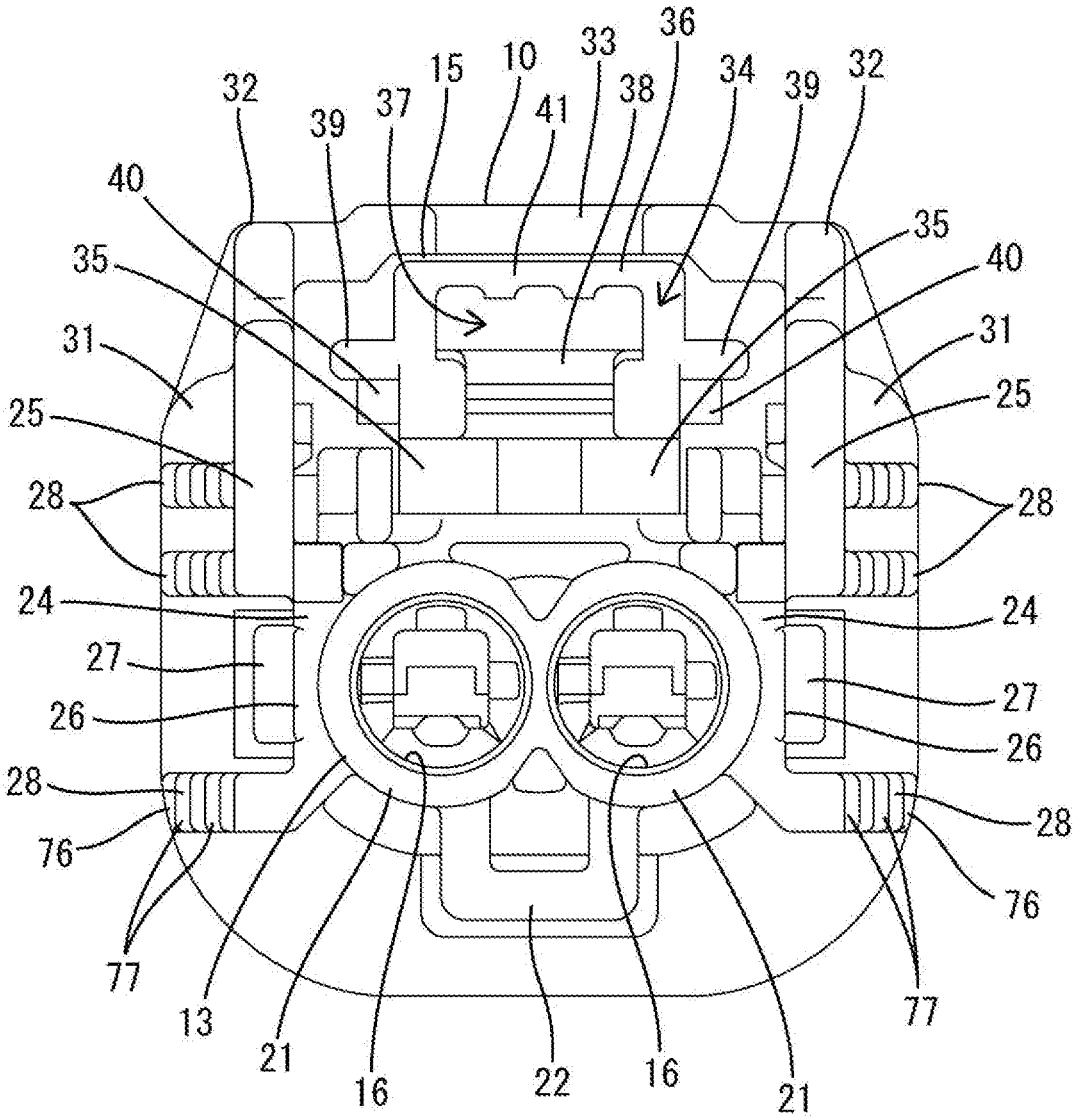
FIG. 17 is a back view of the housing.
Figure 18:
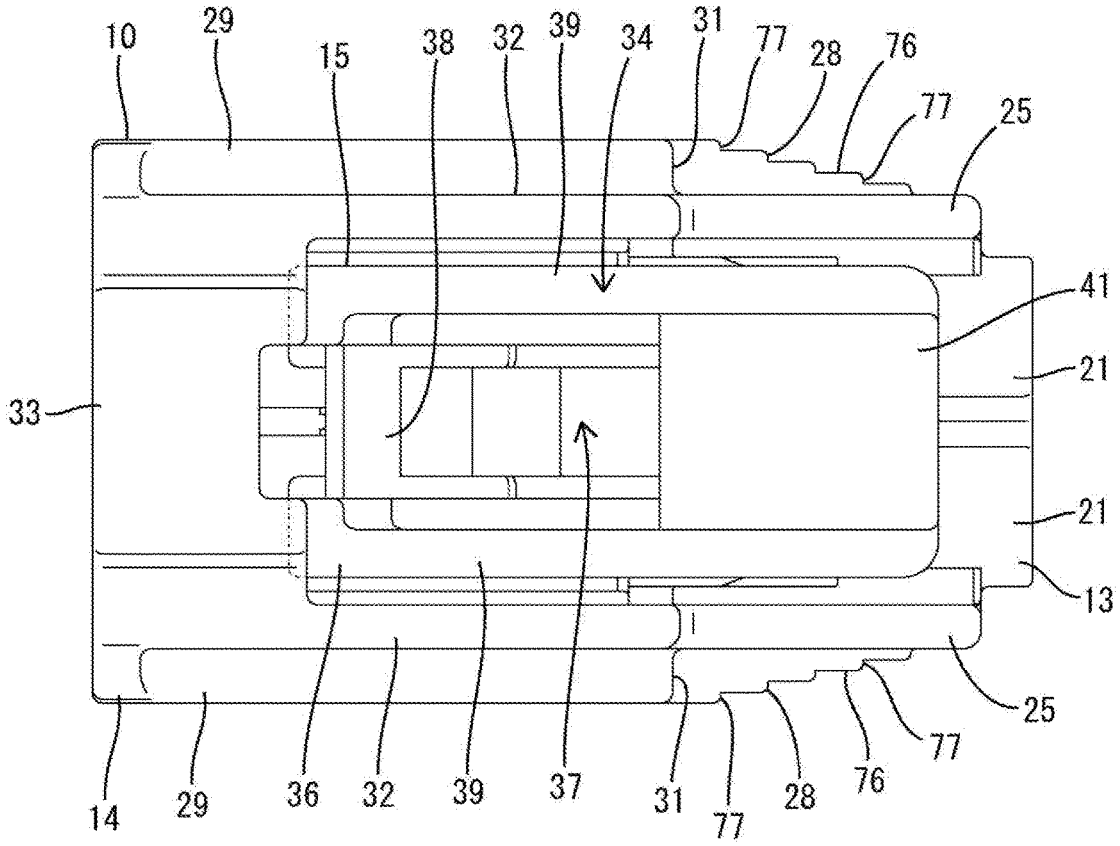
FIG. 18 is a plan view of the housing.

The housing 10 is made of synthetic resin and includes, as shown in FIGS. 16 to 18, a housing body 13, a fitting tube 14 and a lock arm 15.

Figure 6:
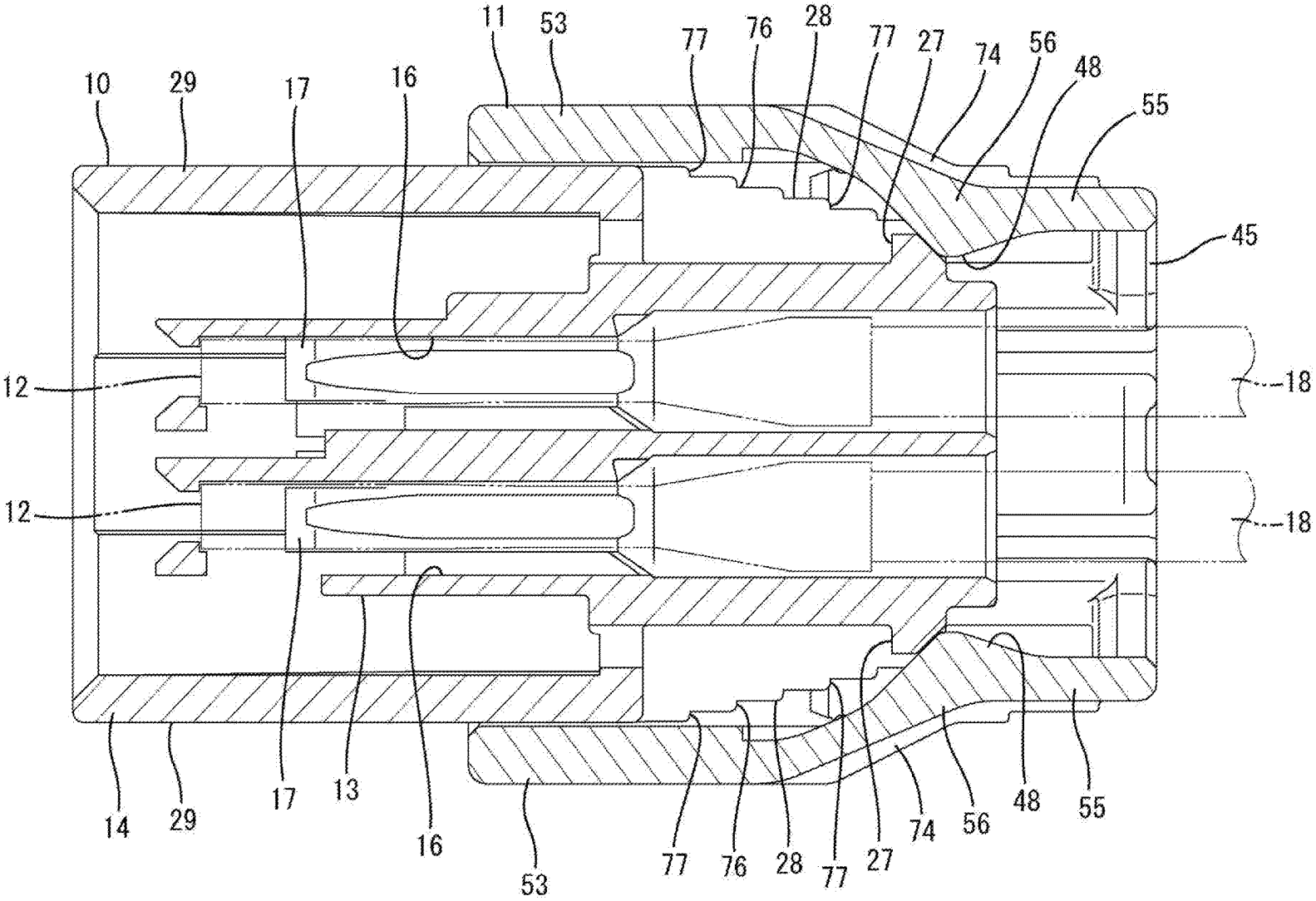
FIG. 6 is a section showing the detector held at the standby position with respect to the housing and interfering portions of resilient pieces facing protrusions of the housing.

As shown in FIG. 6, cavities 16 penetrate the housing body 13 in the front-rear direction, and a deflectable locking lance 17 projects forward at the lower surface of each cavity 16. The cavities 16 are paired in a width direction in the housing body 13 and the terminal fittings 12 are inserted therein from behind.

Each terminal fitting 12 is formed integrally such as by bending a conductive metal plate, and is connected electrically and mechanically to an end part of a wire 18. As shown in FIG. 5, the terminal fitting 12 includes a tubular connecting portion 19 into which the mating terminal fitting 92 is inserted for connection. The locking lance 17 engages the connecting portion 19 to retain terminal fitting 12 in the cavity 16.

An unillustrated front retainer is mounted in a front part of the housing body 13. The front retainer is mounted in the front part of the housing 13 to restrict deflection of the locking lances 17 for secondarily retaining the terminal fittings 12 in the cavities 16.

As shown in FIGS. 16 to 18, a rear part of the housing body 13 includes tubular portions 21 in the form of two connected cylinders defining the respective cavities 16. The wire 18 connected to each terminal fitting 12 is pulled to outside from the rear end of each tubular portion 21. An unillustrated rubber plug is fit on the wire 18 and inserted in each tubular portion 21 in a liquid-tight manner.

Figure 3:
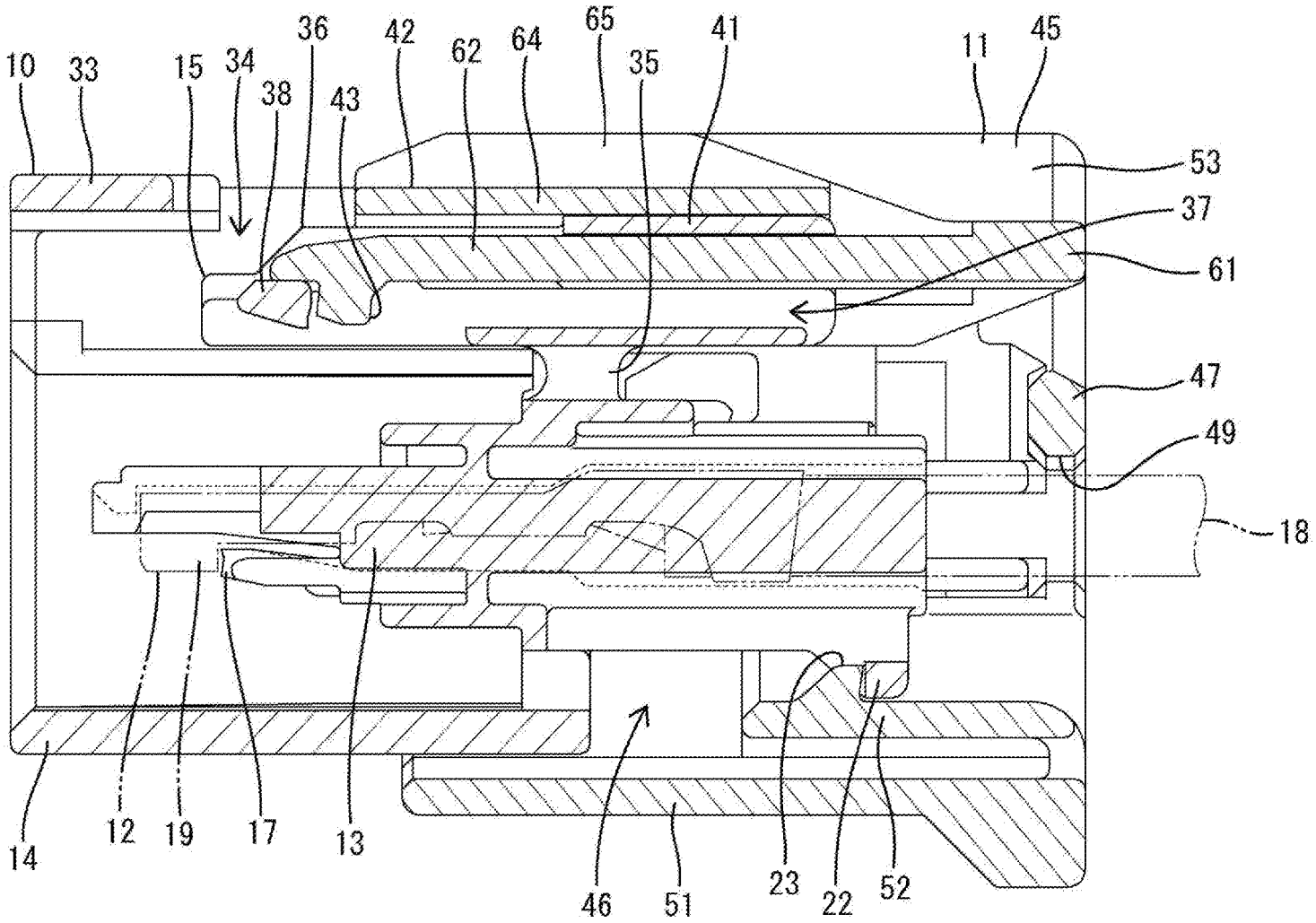
FIG. 3 is a section along A-A of FIG. 1.

As shown in FIG. 17, each tubular portion 21 includes a retaining protrusion 22 projecting down from a widthwise central part of a lower end. As shown in FIG. 3, each retaining protrusion 22 is lockable to a later-described locking claw 23 of the detector 11.

As shown in FIG. 17, the housing body 13 includes two side surfaces 24 on widthwise sides of the respective tubular portions 21, and facing walls 25 rise vertically from upper parts of the side surfaces 24. As shown in FIG. 16, each facing wall 25 is formed over substantially the entire length of the housing 10 in the front-rear direction.

As shown in FIG. 17, each side surface 24 includes a rectangular recess 26 between upper and lower parts, and a claw-like protrusion 27 is on the back surface of the recess 26. The protrusion 27 has such a projecting dimension to be confined within a depth of the recess 26. A projecting end part of the rear surface of the protrusion 27 is tapered and inclined rearward and the front surface of the protrusion 27 is arranged along the width direction.

Housing ribs 28 are formed on upper and lower parts of each side surface 24 and extend parallel to one another in the front-rear direction. Two housing ribs 28 are on the upper part and one housing rib 28 is on the lower part, and these housing ribs 28. The housing rib 28 on the lower part of each side surface 24 has a larger vertical thickness than the housing ribs 28 on the upper part and extends over the entire height of the lower part. Each housing rib 28 has a stepped shape such that a lateral projecting amount is reduced gradually toward the rear.

The fitting tube 14 surrounds the outer periphery of a front part of the housing body 13 and the receptacle 91 of the mating housing 90 is finable between the fitting tube 14 and the front part of the housing body 13. An unillustrated seal ring is fit externally on the housing body 13 and is interposed in a liquid-tight manner between the receptacle 91 and the housing body 13 when the housings 10, 90 are connected properly.

As shown in FIGS. 17 and 18, the fitting tube 14 includes two side wall lower portions 29 covering both sides of the front part of the housing body 13. There is a step 31 between each side wall lower portion 29 and each side surface portion 24, and the front end of each housing rib 28 is integrally connected to an end surface constituting the step 31.

As shown in FIG. 16, the rear part of the housing 10 includes housing narrowing portions 76 on the respective housing ribs 28. The housing narrowing portions 76 gradually reduce a width of a front part of the fitting tube 14 via every housing step 77 from side surfaces (outer surfaces) of the respective side wall lower portions 29 toward a rear side.

The fitting tube 14 includes side wall upper portions 32 rising from the upper ends of the respective side wall lower portions 29 and integrated with front parts of the facing walls 25. Further, the fitting tube 14 includes a bridge 33 spanning between the upper ends of the respective side wall upper portions 32. Open spaces 34 are formed between the facing walls 25 and the bridge 33 and are open upward and rearward.

The lock arm 15 includes legs 35 arranged between the facing walls 25. The legs 35 are paired in the width direction and rise from the upper surface of the housing body 13, as shown in FIG. 17. An arm body 36 extends forward and rearward from upper ends of the legs 35 and is exposed to the open spaces 34, as shown in FIG. 3. The arm body 36 can be tilted and displaced resiliently in a seesaw manner in the vertical direction with the legs 35 as supports.

The arm body 36 includes a rearwardly open assembly space 37 extending in the front-rear direction, as shown in FIG. 3. A housing lock 38 closes a front end of the assembly space 37, two rails 39 close both widthwise sides of the assembly space 37, as shown in FIG. 18, and a plate 41 closes a rear-upper side of the assembly space 37.

As shown in FIG. 3, a detecting body 42 of the detector 11 is inserted into the assembly space 37 of the arm body 36. The detecting body 42 has a detector locking portion 43, and the housing lock 38 is locked to a rear surface of the detector locking portion 43 facing the assembly space 37, as shown in FIG. 3, before the housings 10, 90 are connected properly. Additionally, the lock 93 of the mating housing 90 is locked to the rear surface of housing lock 38, as shown in FIG. 5 when the housings 10, 90 are connected properly. Laterally protruding parts of the respective rails 39 are inserted into rail grooves 44 of the detecting body 42 to guide the assembling of the detector 11.

Housing side locking projections 40 project on both widthwise sides of the arm body 36. Each housing side locking projection 40 is claw-like and coupled to the lower surface of the laterally protruding part of the corresponding rail 39, as shown in FIG. 17. Each housing side locking projection 40 is lockable to a detector side locking projection 68 of the detector 11.

Figure 12:
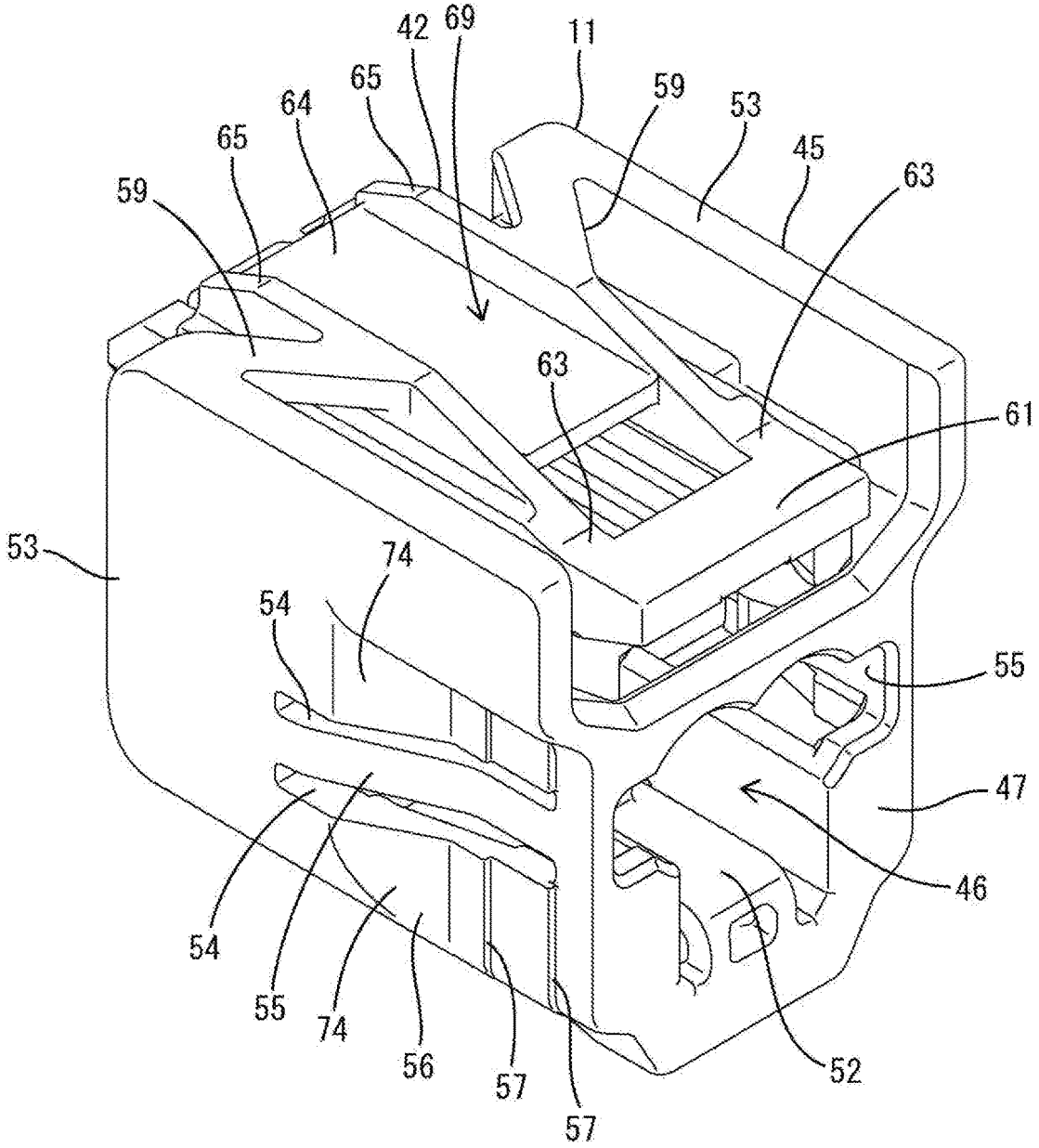
FIG. 12 is a perspective view of the detector.
Figure 13:
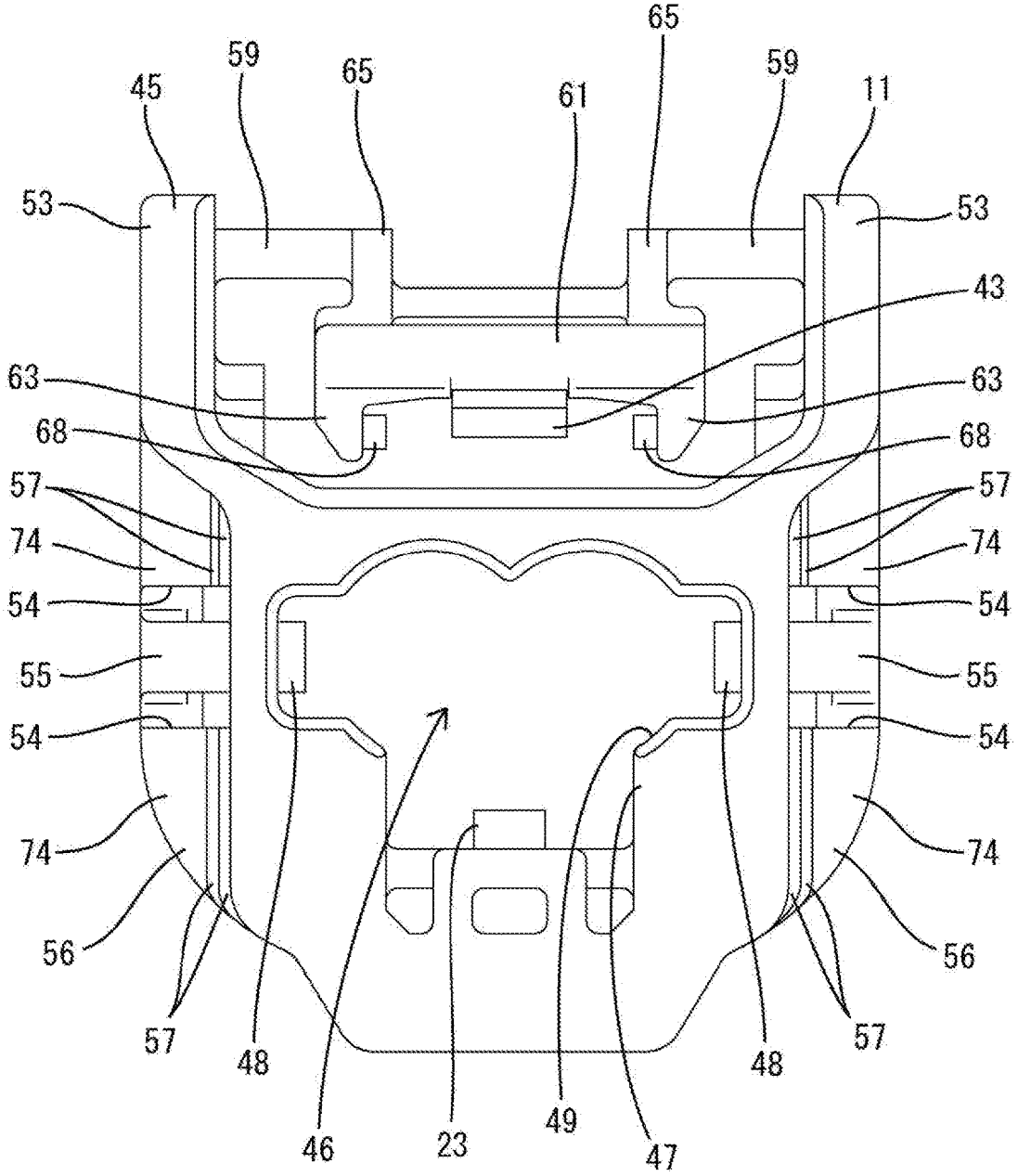
FIG. 13 is a back view of the detector.
Figure 14:
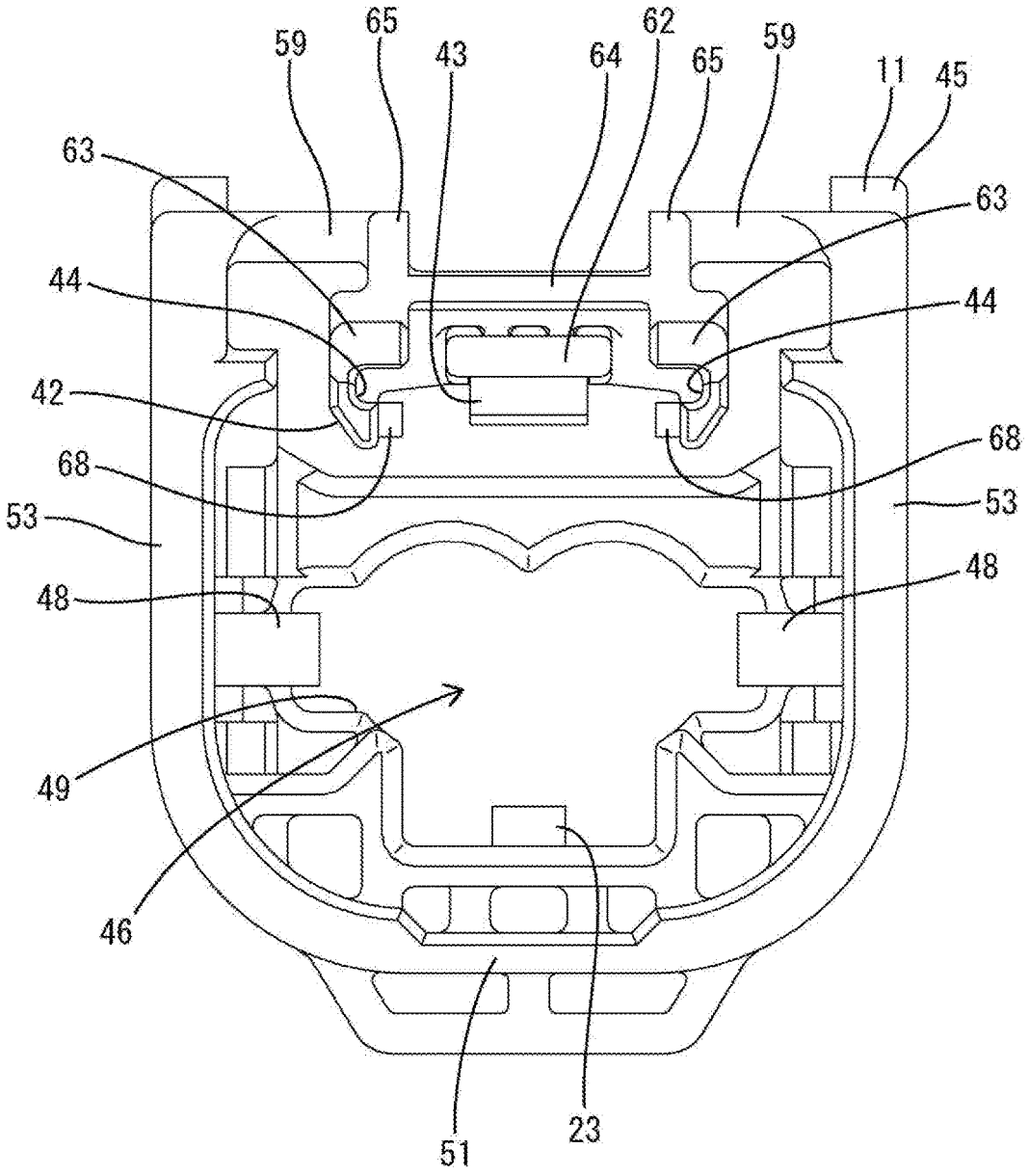
FIG. 14 is a front view of the detector.

As shown in FIGS. 12 to 14, the detector 11 includes a fitting 45 and the detecting body 42. The fitting 45 includes an insertion space 46 inside. The detector 11 is movable in the front-rear direction with respect to the housing 10 to a standby position where the housing body 13 is inserted shallowly in the insertion space 46, as shown in FIG. 3, and to a detection position where the housing body 13 is inserted deeply in the insertion space 46 as shown in FIG. 5.

As shown in FIG. 13, the fitting 45 includes a back wall 47 for closing a rear side of the insertion space 46. A central part of the back wall 47 includes a wide through hole 49 that makes interfering portions 48 and the locking claw 23 visually confirmable. At the detection position, the respective tubular portions 21 of the housing body 13 are fit in the through hole 49 of the back wall 47 and the back wall 47 surrounds the entire peripheries of the tubular portions 21.

As shown in FIG. 14, the fitting 45 has a lower wall 51 for closing a lower side of the insertion space 46, and a deflectable retaining arm 52 projects forward in a widthwise center of a rear part of the lower wall 51. As shown in FIG. 3, a locking claw 23 projects up on a front part of the retaining arm 52. The locking claw 23 is locked to the retaining protrusion 22 of the housing 10 after the retaining arm 52 is deflected.

Figure 7:
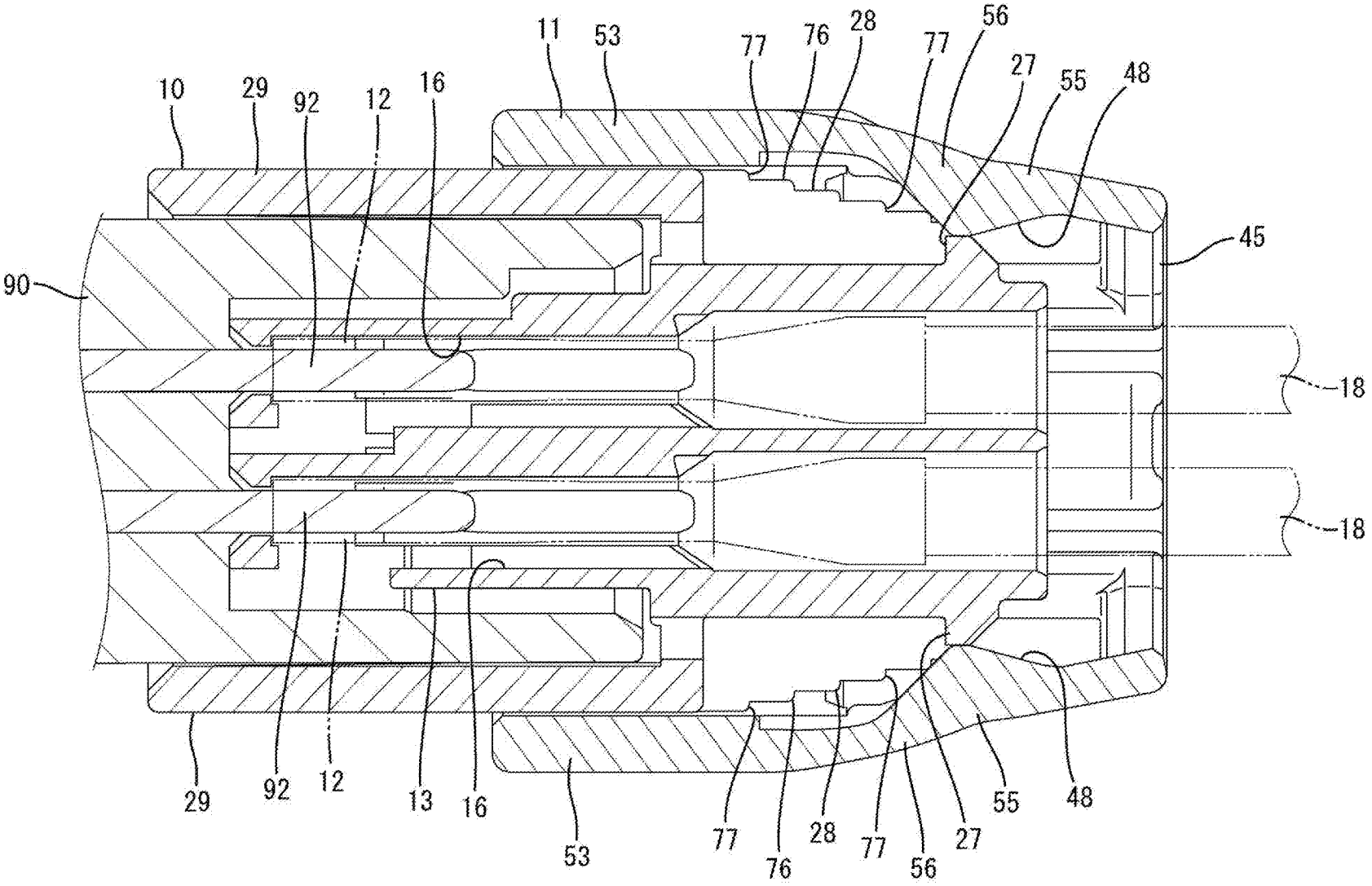
FIG. 7 is a section showing a state where the interfering portions ride on the protrusions and the resilient pieces are bulging out in the process of properly connecting the housing to the mating housing and moving the detector toward the detection position.
Figure 8:
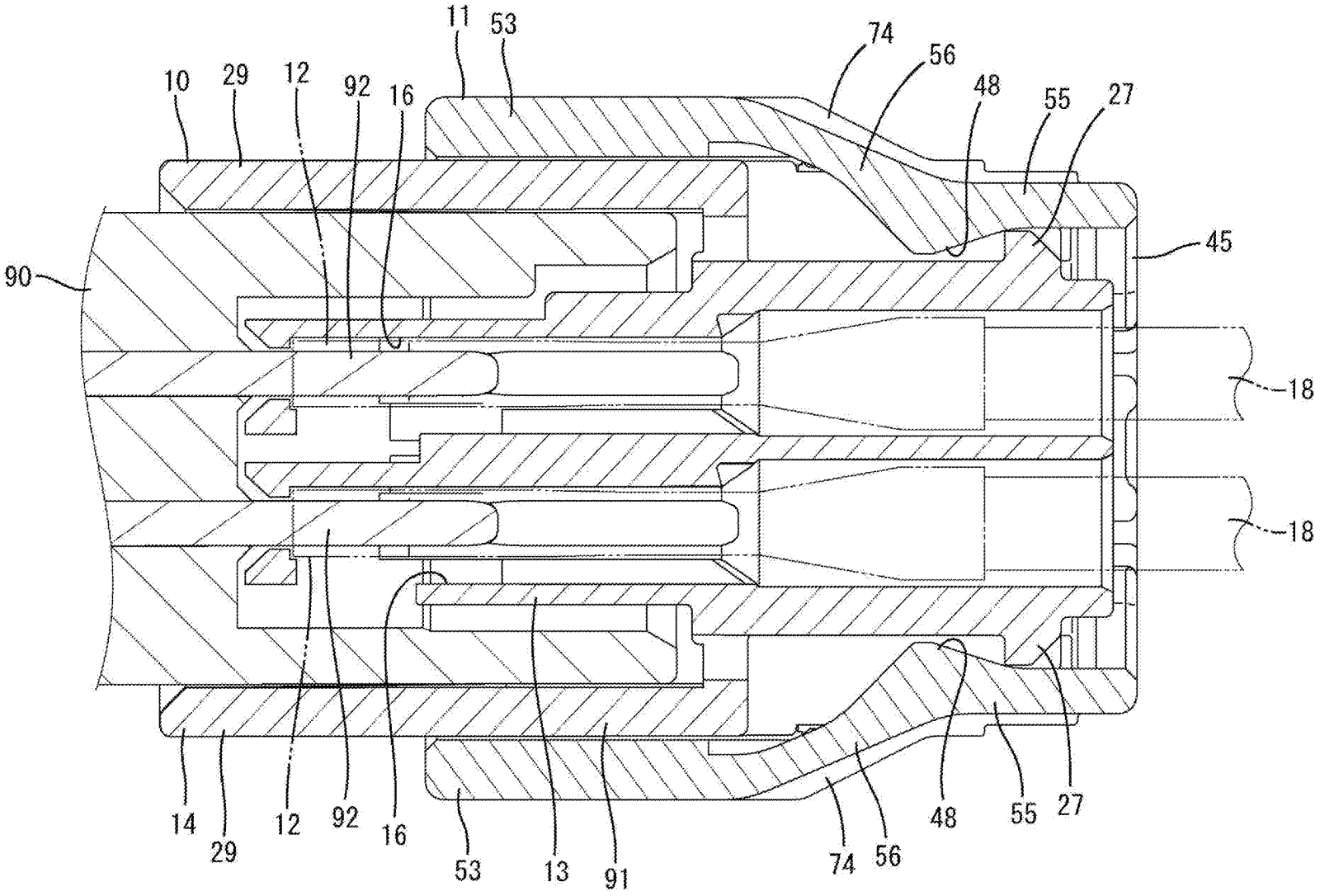
FIG. 8 is a section showing a state where the detector has moved to the detection position and the interfering portions and the protrusions are spaced from each other in a front-rear direction.
Figure 9:
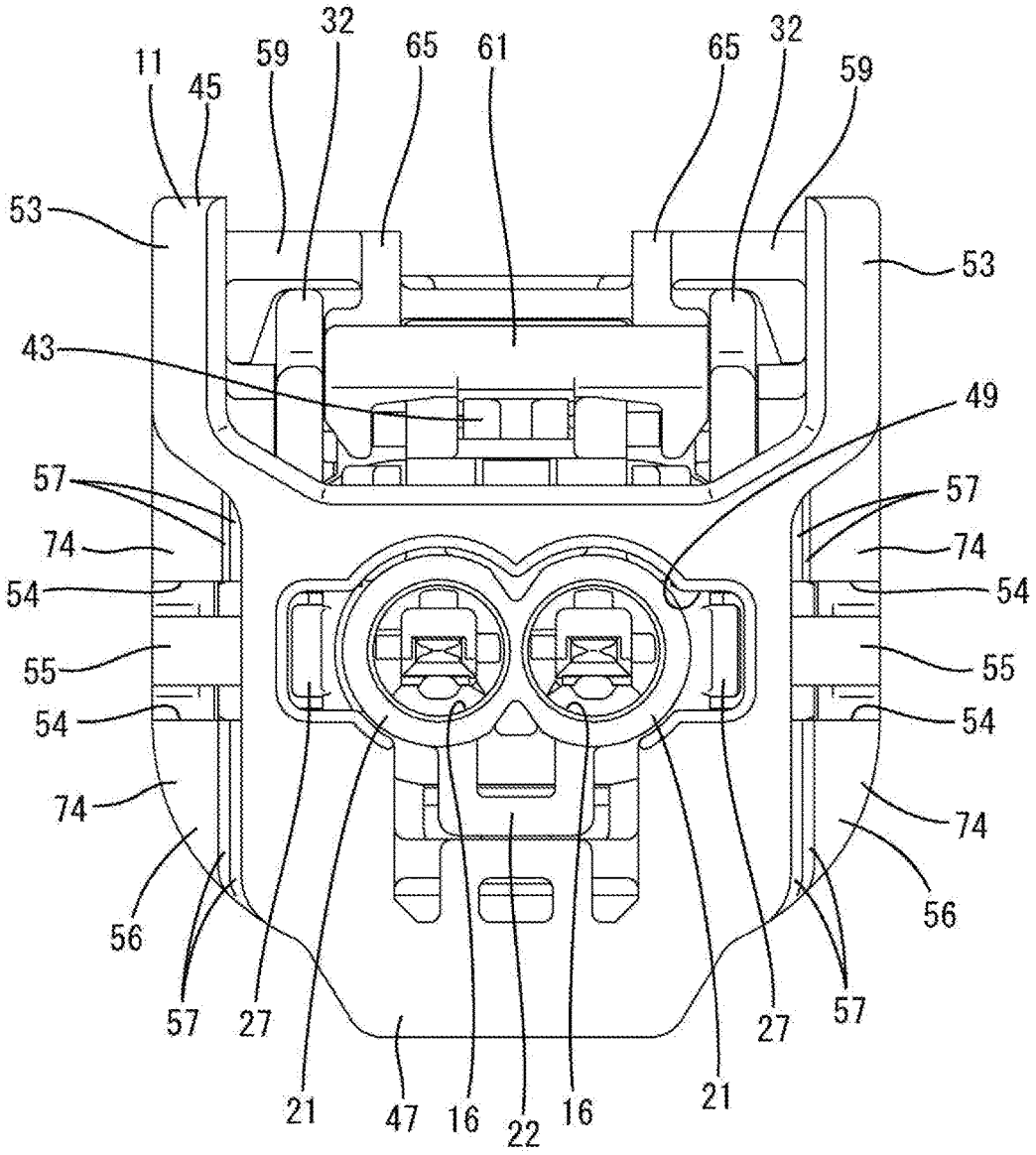
FIG. 9 is a back view showing the state where the detector is held at the standby position with respect to the housing.
Figure 10:
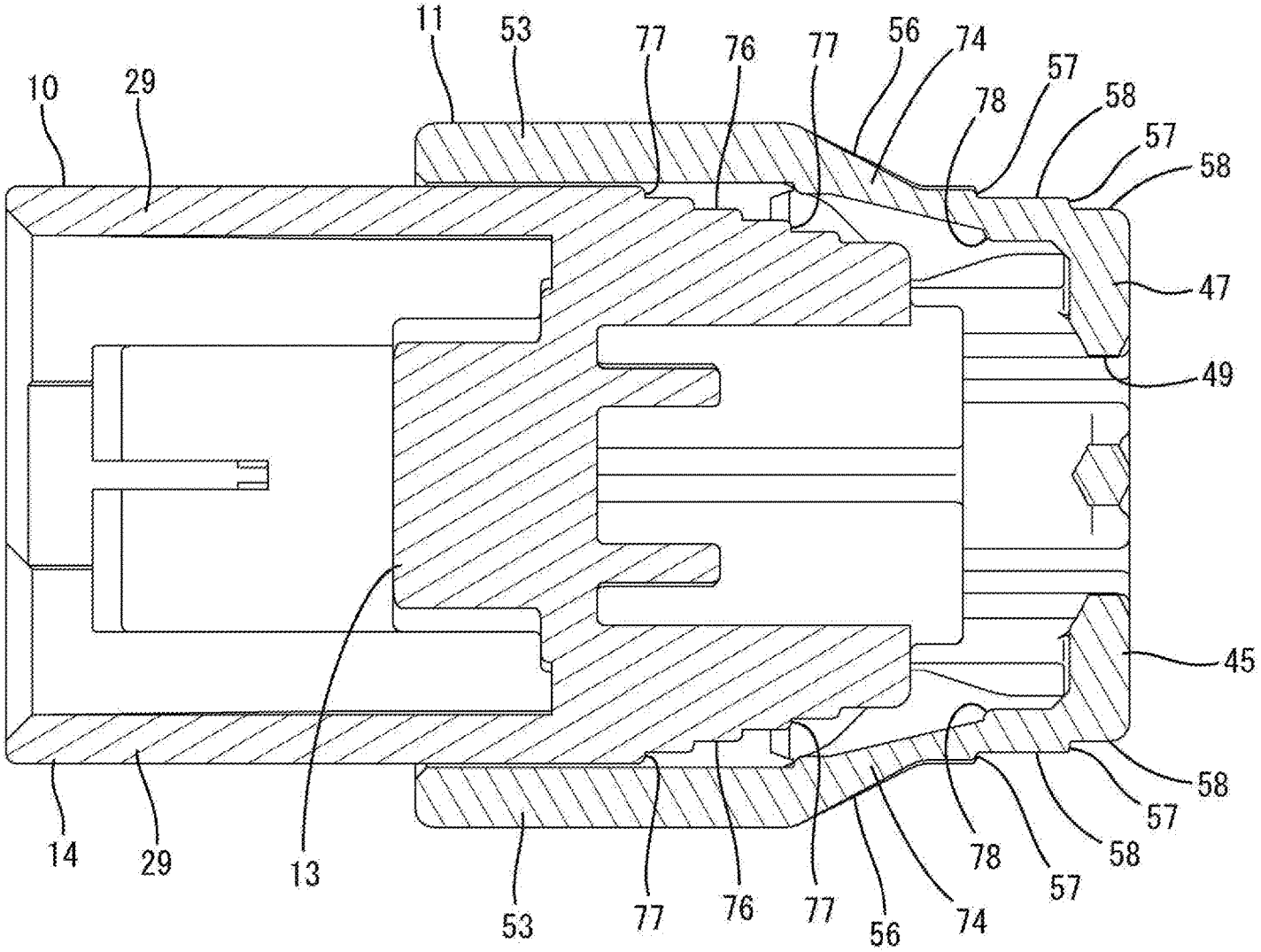
FIG. 10 is a section showing a state where the detector is held at the standby position with respect to the housing and housing narrowing portions and detector narrowing portions are arranged apart from each other in the front-rear direction.

As shown in FIG. 13, side walls 53 are on both widthwise ends of the fitting 45 for closing both widthwise sides of the insertion space 46 on. As shown in FIG. 10, each side wall 53 includes upper and lower slits 54 extending long in the front-rear direction and a strip-like resilient piece 55 between the upper and lower slits 54. Each resilient piece 55 is in the form of a beam supported on both ends and is deflectable with parts coupled to front and rear end parts of the corresponding side wall 53 as supports. As shown in FIGS. 6 to 8, each resilient piece 55 includes the claw-like interfering portion 48 having a chevron-shaped cross-section and projecting on a rear part of an inner surface. A projecting part of the rear surface of the interfering portion 48 is tapered and inclined forward and the front surface of the interfering portion 48 is arranged along the width direction. The interfering portion 48 can interfere with the protrusion 27 of the housing 10.

As shown in FIG. 12, rear parts of the respective side walls 53 include detector narrowing portions 56 recessed inward from the front and upper parts and making a width between the respective side walls 53 smaller with respect to a front part. Each resilient piece 55 is provided in each detector narrowing portion 56 except a front part. As shown in FIG. 6, an outer side surface of each resilient piece 55 is tapered from a front end part toward a rear end to narrow the width in each detector narrowing portion 56, and is formed substantially along the front-rear direction to maintain a constant width from an intermediate position corresponding to the interfering portion 48 to the rear end. An inner side surface of each resilient piece 55 is curved from a front part to a tip part of the interfering portion 48 to narrow the width in each detector narrowing portion 56, and is formed substantially along the front-rear direction to the rear end of each side wall 53 after being temporarily widened from the tip part of the interfering portion 48 to the rear end of the interfering portion 48.

As shown in FIG. 12, each side wall 53 includes upper and lower peripheral portions 74 in areas adjacent to each resilient piece 55 via the upper and lower slits 54. As shown in FIG. 10, the outer surface of each peripheral portion 74 is tapered to narrow the width from a front part toward a rear side, and formed to gradually narrow the width in a step-like manner from an intermediate position to the rear end.

Figure 11:
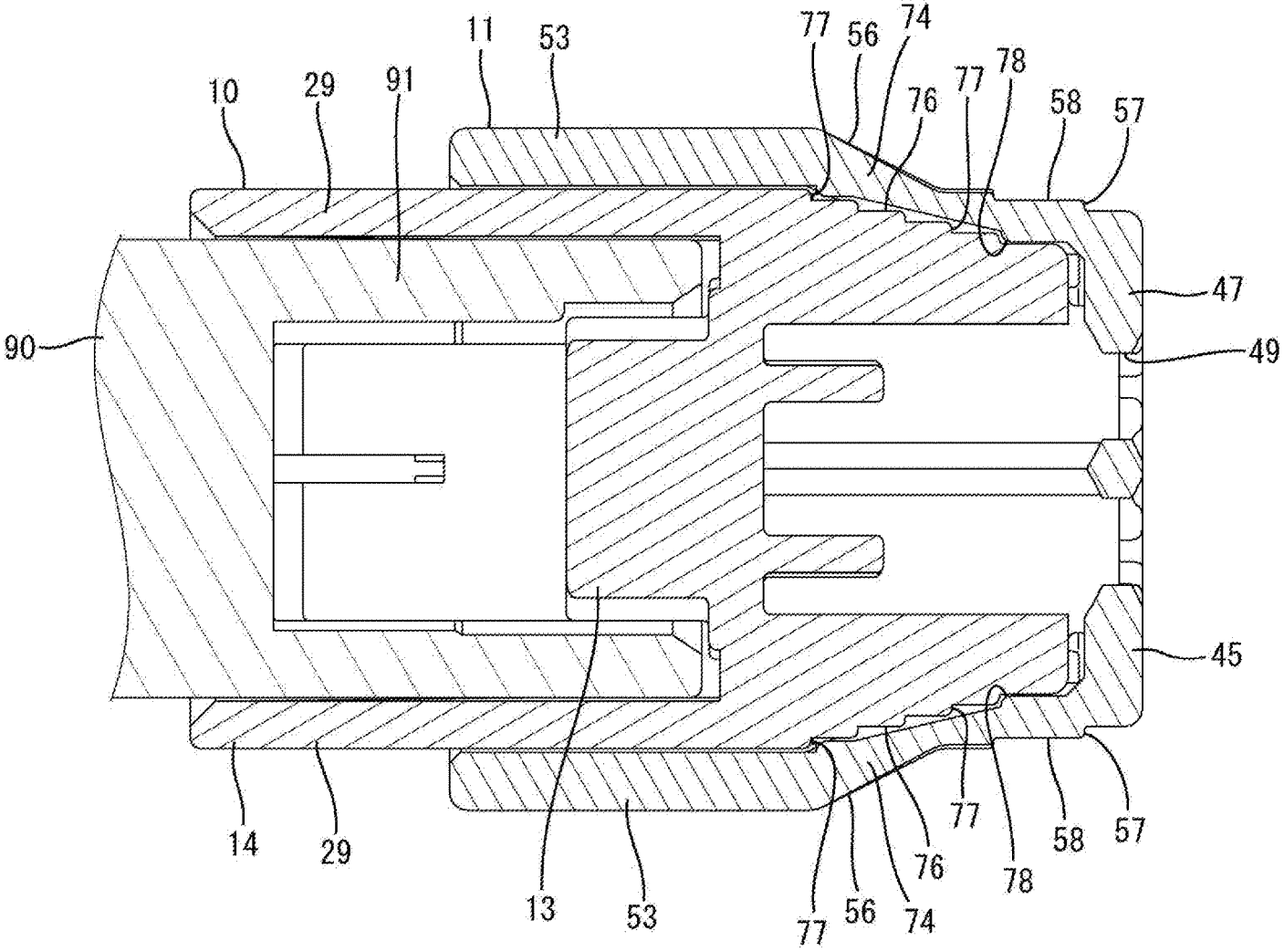
FIG. 11 is a section showing a state where the housing is properly connected to the mating housing, the detector has moved to the detection position and the housing narrowing portions and the detector narrowing portions are arranged to face and contact each other.

As shown in FIG. 10, the inner surface of each peripheral portion 74 is tapered to narrow the width from a front part toward a rear end, and is formed to narrow the width via a facing step 78 from an intermediate position to a rear end. A tapered narrowing area on the inner surface of each peripheral portion 74 is longer in the front-rear direction than a tapered narrowing area on the outer surface of each peripheral portion 74 and is arranged along the inclination of each housing narrowing portion 76 when the detector 11 is at the detection position, as shown in FIG. 11. Further, the facing step 78 of each peripheral portion 74 is arranged to face and to contact with the housing step 77 on a rear end part of each housing rib 28 when the detector 11 is at the detection position.

Rearward facing surfaces 57 (steps) extend short distances in the width direction and face rearward. Laterally facing surfaces 58 extend along the front-rear direction and face laterally. The rearward facing surfaces 57 and the laterally facing surfaces 58 are disposed alternately in the front-rear direction in a part of the outer surface of each peripheral portion 74 narrowing the width in a stepped manner from the intermediate position to the rear end. Each rearward facing surface 57 is formed along a line extending vertically in a side view, and the respective rearward facing surface portions 57 are located successively more outward toward a front, as shown in FIG. 13. The outer surface of the resilient piece 55 is recessed slightly inward from the outer surfaces of the respective upper and lower peripheral portions 74 in the detector narrowing portion 56, as shown in FIG. 12.

Figure 15:
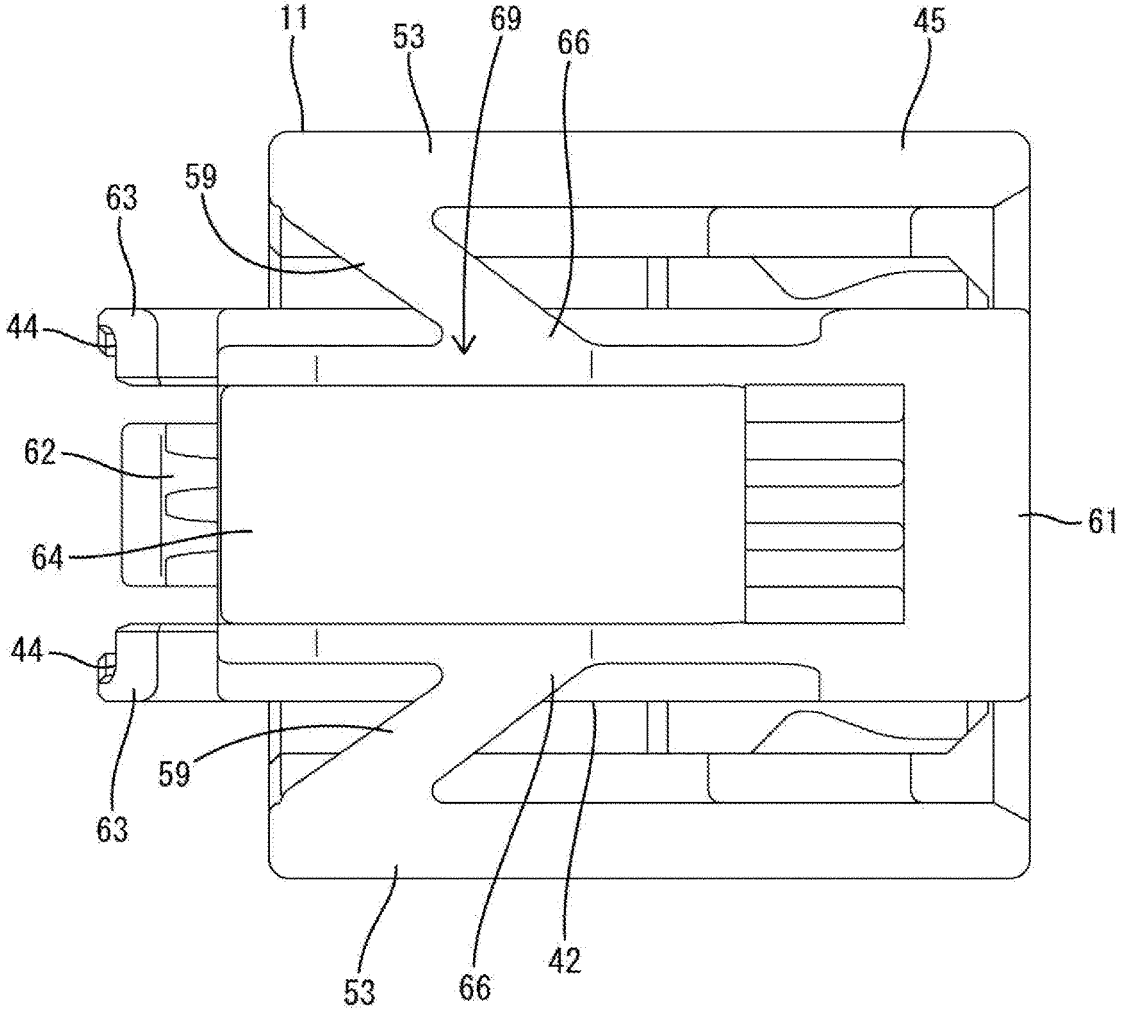
FIG. 15 is a plan view of the detector.

As shown in FIG. 15, the detecting body 42 is a plate extending in the front-rear direction between upper ends of the side walls 53. Further, the detector 11 includes two coupling portions 59 bridged between side surfaces on both widthwise sides of the detecting body 42 and the side walls 53.

The detecting body 42 is slidable in the front-rear direction with respect to the lock arm 15 while being inserted in the assembly space 37 of the lock arm 15, and can tilt together with the arm body 36 with the respective coupling portions 59 as supports.

The detecting body 42 includes a base 61 extending in the width direction in a rear end part, a resilient arm 62 projecting forward from a widthwise central part of the base 61, two guide arms 63 projecting forward from both widthwise ends of the base 61, and a plate-like cover 64 bridged between the respective guide arms 63 and arranged to straddle over the resilient arm 62. A front part of the detecting body 42 projects farther forward than the front end of the fitting 45.

Figure 1:
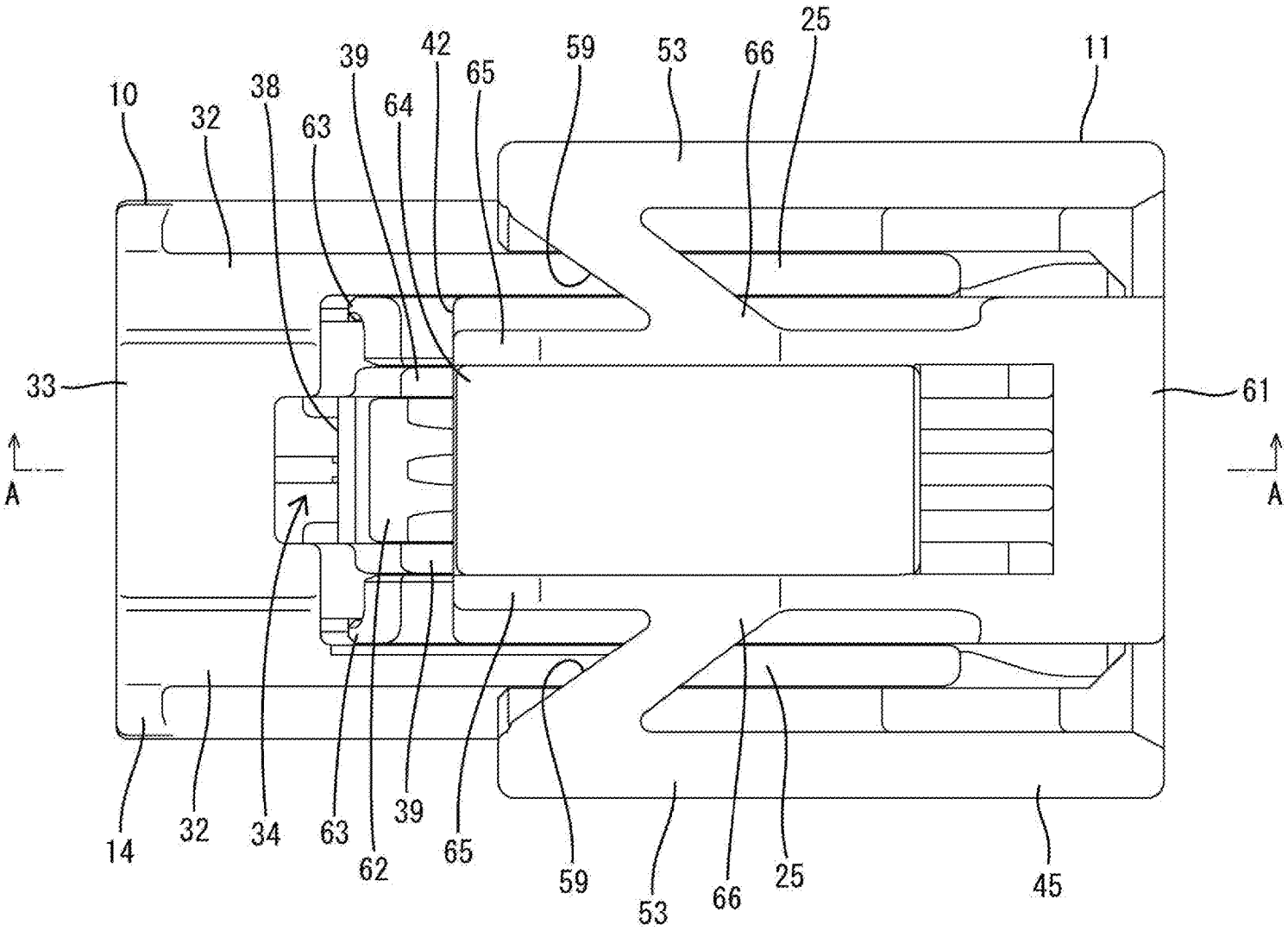
FIG. 1 is a plan view of a connector of one embodiment of the invention showing a state where a detector is held at a standby position with respect to a housing.

The resilient arm 62 and the respective guide arms 63 are parallel to each other. When the detecting body 42 is inserted into the assembly space 37 of the lock arm 15, upward protruding parts of the respective rails 39 are fit into spaces between the resilient arm 62 and the respective guide arms 63 as shown in FIG. 1 and the plate-like portion 41 is fit into a space between the resilient arm 62 and the cover 64, as shown in FIG. 3.

The guide arms 63 include two rail grooves 44 extending in the front-rear direction in the inner surfaces thereof, as shown in FIG. 14. The guide arms 63 are mounted on the lock arm 15 to embrace the respective rails 39 from outside with the laterally protruding parts (see FIG. 17) of the respective rails 39 fit in the respective rail grooves 44.

The guide arms 63 include ribs 65 extending in the front-rear direction while projecting up. As shown in FIG. 3, a rear part of the upper surface of each rib 65 is inclined down toward a rear end. The guide arms 63 include detector side locking projections 68 projecting toward each other on inner sides. The detector side locking projections 68 are arranged on lower surfaces of the corresponding rail grooves 44. When the detector 11 is at the standby position, the detector side locking projections 68 are lockable to the corresponding housing side locking projections 40.

The respective guide arms 63 include two ribs 65 extending in the front-rear direction while projecting up. As shown in FIG. 3, a rear part of the upper surface of each rib 65 is inclined down toward a rear end.

The claw-like detector lock 43 projects down on a front part of the resilient arm 62. The detector lock 43 contacts the rear surface of the housing lock 38 at the standby position to restrict a movement of the detector 11 to the detection position as shown in FIG. 3, and is in contact with the front surface of the housing lock 38 at the detection position to restrict a movement of the detector 11 in a return direction to the standby position, as shown in FIG. 5.

As shown in FIG. 12, the cover 64 has both widthwise sides coupled to lower parts of the inner surfaces of the ribs 65 and the flat upper surface thereof is located slightly below the upper surfaces of the ribs 65. As shown in FIG. 15, the rear end of the cover 64 is spaced apart from the base 61.

As shown in FIG. 15, each coupling 59 is a tapered strip plate extending oblique to the width direction and the front-rear direction from a front end part of the inner surface of each side wall 53 to a substantially central part in the front-rear direction of an upper part of the outer surface of each rib 65 (side surface of the detecting body 42). The upper surface of each coupling 59 is substantially continuous and flush with the upper surface of each rib 65 without any step. The front end of each coupling 59 is at substantially the same position as the front end of each side wall 53 (also the front end of the fitting 45). The coupling 59, the side wall 53 and the rib 65 form substantially a Z-shape in a plan view.

A tilting fulcrum 66 is defined where a rear end of each coupling 59 is connected to the corresponding rib 65 of the detecting body 42 and is twisted and deformed resiliently when the detecting body 42 is tilted. The tilting fulcrum 66 of each coupling 59 is at a position in the front-rear direction overlapping the corresponding leg 35 that serves as a tilting fulcrum of the lock arm 15 and is substantially at the same position as the corresponding leg 35 in the front-rear direction at the standby position.

The fitting 45 includes an opening 69 open upward between the upper ends of the respective side walls 53. As shown in FIG. 15, the detecting body 42 is exposed to the opening 69 and can be visually confirmed from above through the opening 69.

Next, how to connect/separate the housings 10, 90 is described.

Figure 19:
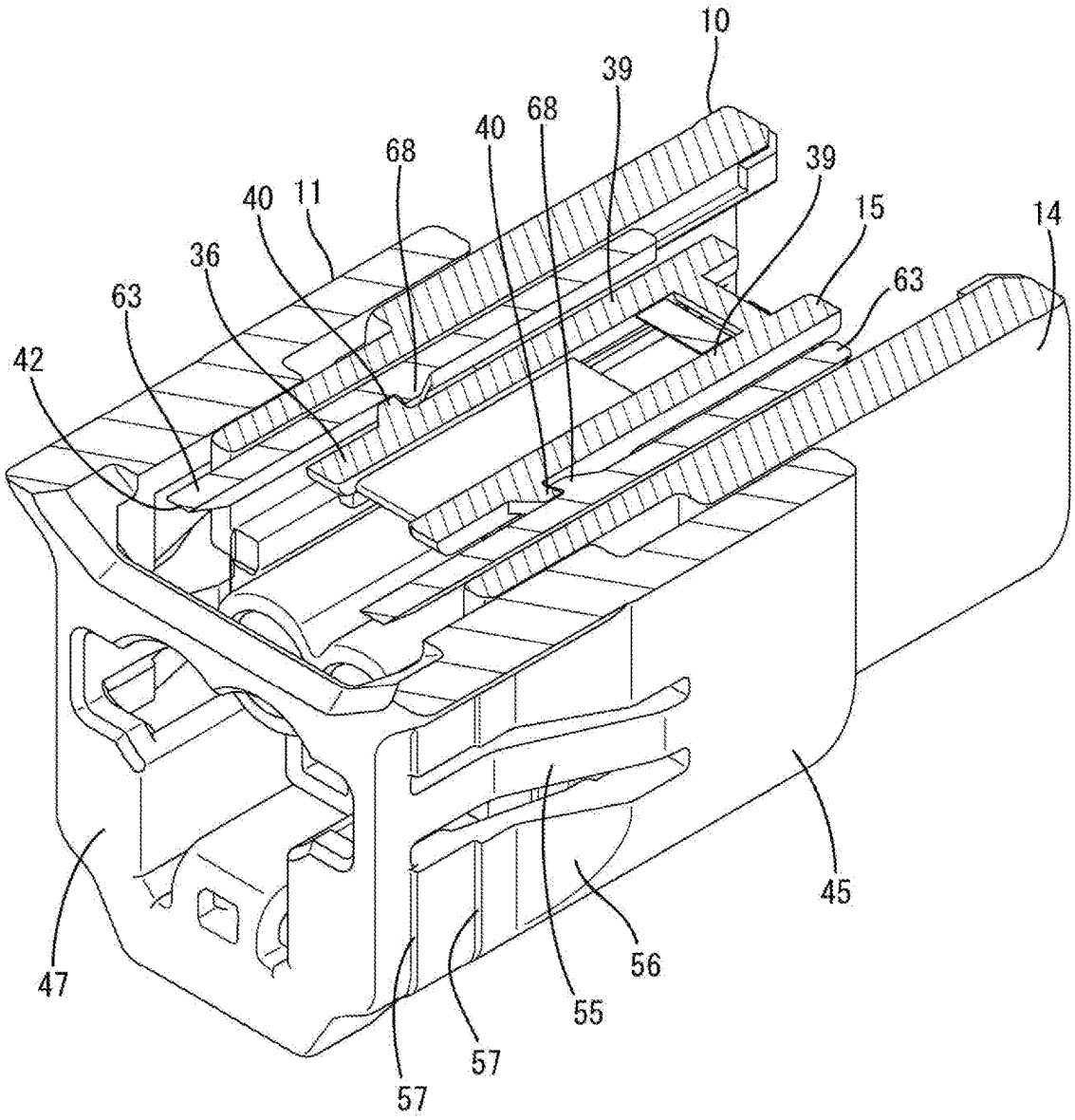
FIG. 19 is a perspective view partly in section showing a state where detector side locking projections are locked to housing side locking projections to restrict the rearward escape of the detector when the detector is at the standby position.

First, the detector 11 is assembled with the housing 10. The assembling of the detector 11 at the standby position is guided by fitting the respective rails 39 of the lock arm 15 into the rail grooves 44 of the respective guide arms 63 and fitting the rear part of the housing body 13 into the insertion space 46. At the standby position, the locking claw 23 of the retaining arm 52 is in contact with the front surface of the retaining protrusion 22 to be lockable to this front surface, as shown in FIG. 3, and the respective detecting member side locking projections 68 are in contact with the front surfaces of the respective housing side locking projections 40 to be lockable to these front surfaces, as shown in FIG. 19. In this way, the detector 11 is retained on both upper and lower sides with respect to the housing 10 and the rearward escape is restricted reliably. Further, the detector lock 43 of the detecting body 42 is in contact with and lockable to the rear surface of the housing lock 38 of the lock arm 15 to restrict forward movement of the detector 11 toward the detection position. Note that the detector 11 can be assembled smoothly at the standby position by placing worker's fingers in contact with the outer surfaces of the peripheral portions 74 of the respective detector narrowing portions 56 and pressing the rearward facing surfaces 57 forward.

Further, at the standby position, a clearance (part of the open space 34 of FIG. 1) is formed between the cover 64 and the bridge 33, as shown in FIG. 1, and a front part of the resilient arm 62 is exposed in this clearance to be visually confirmable. Furthermore, at the standby position, the interfering portions 48 of the respective resilient pieces 55 are arranged to face and to contact projecting inclined parts of the rear surfaces of the respective protrusions 27 from behind, as shown in FIG. 6.

The housing 10 then is connected to the mating housing 90. In the process of connecting the housings 10, 90, the housing lock 38 of the arm body 36 rides on the lock 93, and the arm body 36 is tilted in a seesaw manner in the vertical direction with the legs 35 as supports, as shown in FIG. 4. At this time, the detecting body 42 also tilts with the arm body 36 with the respective couplings 59 as supports. Since the tilting fulcrums 66 of the respective couplings 59 and the respective legs 35 are arranged at the same position in the front-rear direction, a tilting displacement of the lock arm 15 and that of the arm body 36 are synchronized satisfactorily substantially without interfering with each other.

When the housings 10, 90 are connected properly, the arm body 36 resiliently returns to an initial substantially horizontal state and the lock 93 is in contact with the rear surface of the housing locking portion 38 to be lockable to this rear surface. On the other hand, the detector locking portion 43 is pushed up by the lock 93 and unlocked from the housing locking portion 38. In this way, a movement of the detector 11 from the standby position to the detection position in front of the standby position is allowed. Further, when the housings 10, 90 are connected properly, the respective mating terminal fittings 92 are inserted to a proper depth into the connecting portions 19 of the respective terminal fittings 12 to be connected electrically.

Subsequently, the detector 11 is moved to the detection position while being gripped by fingers. The worker can move the detector 11 toward the detection position by placing the his or her fingers in contact with the outer surfaces of the respective peripheral portions 74 of the respective detector narrowing portions 56 and pushing the respective peripheral portions 74.

In the process of moving the detector 11 to the detection position, the interfering portions 48 of the respective resilient pieces 55 contact with and ride on the respective protrusions 27 and the respective resilient pieces 55 are deflected and deformed to bulge out from the recessed surfaces 56, as shown in FIG. 7. At this time, the worker can touch the bulging resilient pieces 55 (in particular, the rearward facing surfaces 57 and the laterally facing surfaces 58 of the resilient pieces 55) while his fingers are pushed by the resilient pieces 55, and can feel the bulge of each resilient piece 55 through the fingers. Further, in the process of moving the detector 11 to the detection position, the detecting member locking portion 43 slides on the upper surface of the housing locking portion 38, and the resilient arm 62 is deflected and deformed with a rear end side near the base 61 as a support.

Figure 2:
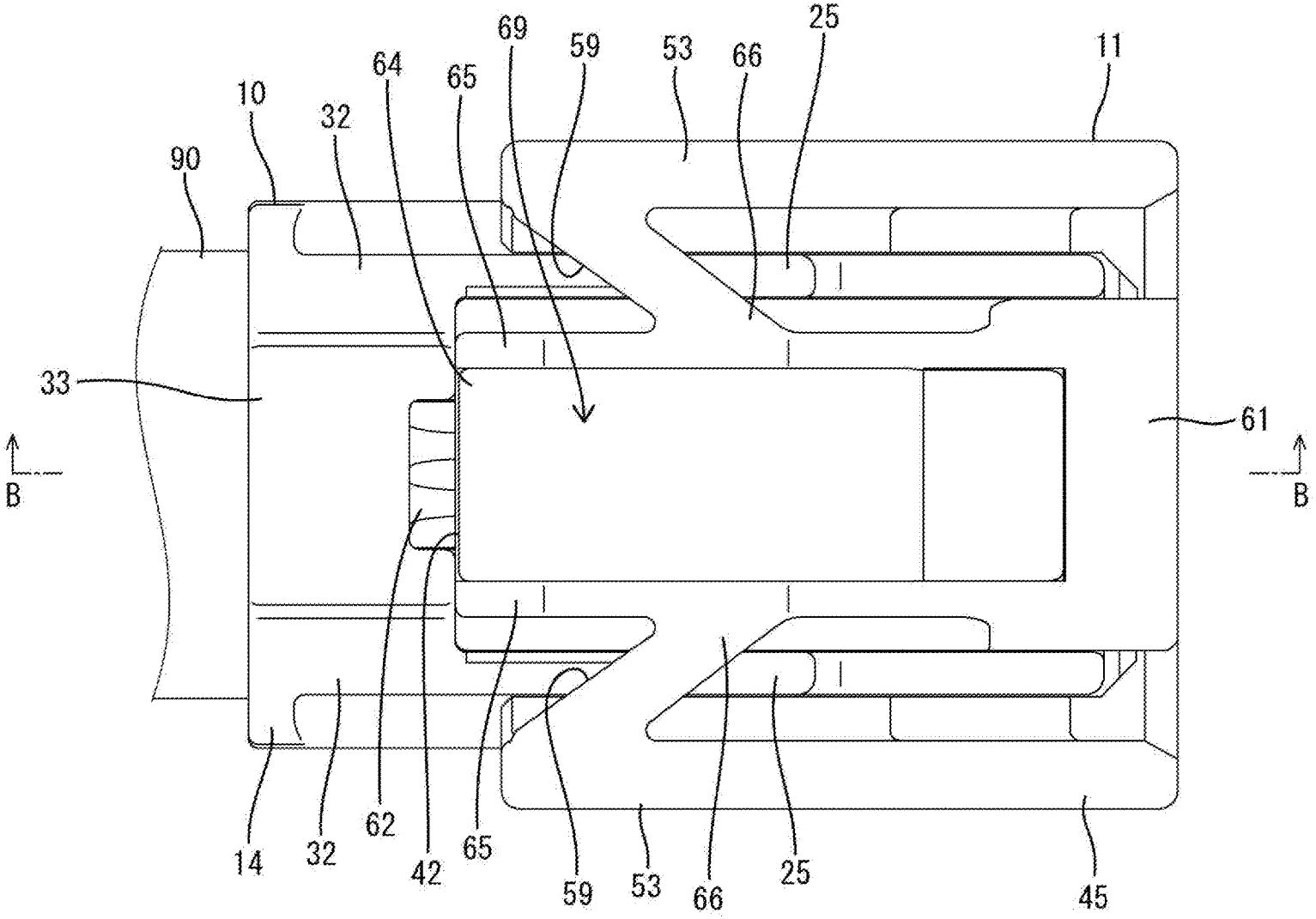
FIG. 2 is a plan view showing the housing connected properly to a mating housing and the detector moved to a detection position with respect to the housing.

Immediately before the detector 11 reaches the detection position, the interfering portions 48 of the resilient pieces 55 ride over the protrusions 27 and the resilient pieces 55 resiliently return to eliminate the bulge. As the resilient pieces 55 resiliently return, the detector 11 arrives at the detection position at once and the resilient arm 62 also resiliently returns. Thus, the detector locking portion 43 is in contact with the front surface of the housing locking portion 38 to be lockable to this front surface, as shown in FIG. 3. In this way, a movement of the detector 11 in the return direction to the standby position is restricted. Further, since the front end of the cover 64 is arranged to contact the bridge 33, as shown in FIG. 2, and the back wall 47 of the fitting 45 is arranged to contact the rear part of the housing body 13, a forward movement of the detector 11 beyond the detection position is restricted. A front part of the resilient arm 62 is hidden inside the bridge 33 and cannot be seen from above.

When the detector 11 is at the detection position, the interfering portions 48 of the resilient pieces 55 are separated forward from the protrusions 27 and are not in contact with the respective protrusions, as shown in FIG. 8. Further, at the detection position, the detector narrowing portions 56 of the side walls 53 are arranged to correspond to and be able to contact (contact or proximate) with the respective housing narrowing portions 76 as shown in FIG. 11. Specifically, the detector narrowing portion 56 is located so that an oblique part of the inner surface of each peripheral portion 74 adapts to the inclination of each housing narrowing portion 76 (inclination obtained by connecting the respective housing steps 77 of each housing rib 28).

If the housings 10, 90 are not connected properly and the lock 93 is not locked to the housing locking portion 38, the detector locking portion 43 is kept locked to the housing locking portion 38. Thus, the detector 11 cannot be moved from the standby position to the detection position. Therefore, it can be judged that the housings 10, 90 are connected properly if the detector 11 can be moved toward the detection position and the housings 10, 90 are not connected properly unless the detector 11 can be moved to the detection position.

That the detector 11 at the detection position can be detected by visually confirming a moving state of the detector 11 with respect to the housing 10, for example, by visually confirming a state where the front end of the cover 64 is in contact with the bridge 33 as shown in FIG. 2. Further, a movement of the detector 11 to the detection position also can be sensed by an operation feeling when the resilient arm 62 resiliently returns.

The presence of the detector 11 at the detection position also can be detected tactually by fingers of a worker. Specifically, the worker moves the detector 11 to the detection position while placing his or her fingers in contact with the rearward facing surfaces 57 of the respective peripheral portions 74 arranged adjacent to the resilient pieces 55 in the detecting member narrowing portions 56 of the side walls 53. Thus, the fingers can confirm the existence or the elimination of the bulge of each resilient piece 55. At this time, since the resilient pieces 55 are arranged to be recessed from the respective upper and lower peripheral portions 74, the worker's fingers touch the respective resilient pieces 55 only when the respective resilient pieces 55 bulge. Therefore, in the process of moving the detector 11 to the detection position, it is prevented that the worker's fingers constantly touch the respective resilient pieces 55 and there is a little concern about interference with a moving operation of the detector 11.

On the other hand, in separating the housings 10, 90 from each other for maintenance or other reason, fingertips are inserted into the opening 69 of the fitting portion 45 and a rear end side (base 61 and the like) of the detecting body 42 is pushed down by the fingertips. Then, the detecting body 42 is tilted together with the arm body 36 and the lock arm 15 and the lock portion 93 are unlocked from each other. If the detector 11 is pressed rearward in that state, the housings 10, 90 gradually move in separating directions and the detector 11 also moves in the return direction to the standby position. Thereafter, the locking claw 23 of the retaining arm 52 is locked to the retaining protrusion 22, and the detector 11 is kept at the standby position with respect to the housing 10. Thus, the housings 10, 90 are pulled apart from each other.

As described above, the housing narrowing portions 76 for reducing the width toward the rear are provided in the rear part of the housing 10, and the detector narrowing portions 56 narrowing the width toward the rear side correspond to the housing narrowing portions 76 in the rear parts of the respective side walls 53. Thus, the entire rear part of the connector can be narrowed.

Further, since the surfaces facing rearward are formed on the outer surfaces of the respective side walls 53 by narrowing the detector narrowing portions 56, the detector 11 can be moved smoothly from the standby position to the detection position by pressing these surfaces forward. Particularly, since the rearward facing surfaces formed on the outer surfaces of the respective side walls 53 are configured as the plural rearward facing surfaces 57, the worker's fingers will not slip on the detector narrowing portions 56 when the detector 11 is moved, and the detector 11 can be moved more smoothly.

Other embodiments are briefly described below.

The housing narrowing portions and the detector narrowing portions may be narrowed toward the rear while being flat without any step on the side surfaces of the housing and the respective side walls.

The detector may be, for example, structured such that two side walls rise on both widthwise sides across the detecting body without including the fitting.

LIST OF REFERENCE SIGNS

10 . . . housing
11 . . . detector
15 . . . lock arm
28 . . . housing rib
38 . . . housing locking portion
42 . . . detecting body
43 . . . detector locking portion
45 . . . fitting
48 . . . interfering portion
53 . . . side wall
54 . . . slit
55 . . . resilient piece
56 . . . detector narrowing portion
57 . . . rearward facing surface (step)
76 . . . housing narrowing portion
77 . . . housing step
90 . . . mating housing

What is claimed is:

1. A connector, comprising:

a housing having a front end connectable to a mating housing and a rear end opposite the front end; and a detector mounted on the housing from the rear end of the housing in a rear to front direction, the detector being movable from a standby position to a detection position in front of the standby position when the housing is connected properly to the mating housing, wherein:

the housing includes two opposite side walls having outer side surfaces defining a housing narrowing portion narrowed toward the rear end of the housing;

the detector includes two opposite side walls configured to cover areas of both outer side surfaces of the housing in proximity to the rear end of the housing; and the two side walls of the detector include a detector narrowing portion narrowed toward the rear end of the detector to correspond to the housing narrowing portion in a part of the detector facing the housing narrowing portion, wherein the detector narrowing portion further includes steps arranged along the side walls of the detector in the front-rear direction on the outer surfaces of the side walls of the detector.

* * * * *